United States Patent [19]

Pike

[11] 4,082,253

[45] Apr. 4, 1978

[54] BLAST FURNACE PRESSURE EQUALIZING APPARATUS

[75] Inventor: Daniel E. Pike, Harrington Park, N.J.

[73] Assignee: Air Pollution Industries, Inc., Englewood, N.J.

[21] Appl. No.: 667,627

[22] Filed: Mar. 17, 1976

[51] Int. Cl.[2] ..... C21B 7/00

[52] U.S. Cl. ..... 266/147; 266/159

[58] Field of Search ..... 266/144, 146, 147, 156, 266/157, 159, 184

[56] References Cited

U.S. PATENT DOCUMENTS

| | | | |
|---|---|---|---|
| 3,041,059 | 6/1962 | Powell | 266/156 |
| 3,045,996 | 7/1962 | Rice | 266/147 |
| 3,297,432 | 1/1967 | Mohr | 266/159 |
| 3,343,825 | 9/1967 | Tsutsumi et al. | 266/157 |
| 3,726,065 | 4/1973 | Hausberg et al. | 266/147 |
| 3,735,970 | 5/1973 | Genge | 266/156 |

*Primary Examiner*—Gerald A. Dost

*Attorney, Agent, or Firm*—Sommers & Sommers

[57] ABSTRACT

An apparatus located at the top of a blast furnace for equalizing pressure exerted by top gas, generated during operation of the blast furnace, on the bottom surface of the large bell movably mounted in the top of the blast furnace, operable so as to remove pollutants from the top gas and direct the top gas with the pollutants removed therefrom into the large bell hopper at full furnace pressure to exert equalizing pressure on the top surface of the large bell to enable opening of the large bell for feeding charge therethrough into the blast furnace. A stream of water under pressure is directed through a portion of the apparatus so as to generate continuous flow of cleaned top gas into the large bell hopper to maintain full furnace pressure therein, to prevent back flow of top gas into the apparatus upon opening of the large bell for feeding charge therethrough into the blast furnace, and to prevent the formation of pockets of stagnant gas subject to condensing, freezing or exploding due to ambient conditions thereabout. A relief valve is operable so as to vent cleaned top gas to atmosphere in the event that there is a slip in the blast furnace generating a sudden pressure surge, to efficiently relieve the pressure surge and prevent damage to the blast furnace while preventing pollution of the atmosphere.

2 Claims, 5 Drawing Figures

BLAST FURNACE PRESSURE EQUALIZING APPARATUS

BACKGROUND OF THE INVENTION

This invention relates generally to pressure equalizing devices, and more particularly relates to an apparatus for equalizing pressure exerted by top gas, generated during operation of the blast furnace, on the bottom surface of the large bell movably mounted in the top of the blast furnace.

A blast furnace comprises a tall shaft furnace consisting of a cylindrical bottom hearth portion, from which rises an upwardly-widening conically-tapered bosh portion, surmounted by a taller tapered shaft structure which narrows towards the top, where it is closed by means of a top closing device. Such a furnace is generally used for production of pig iron from charge including metallurgical coke, iron ore, and fluxes, which charge is generally fed thereinto stepwise through the top closing device.

During normal operation of a blast furnace, a substantial quantity of gas which includes carbon monoxide, known as top gas, is generated in the top of the blast furnace. Such top gas exerts full furnace pressure on the bottom surface of a large bell movably mounted in the top of the blast furnace, which pressure is partially counterbalanced by pressure exerted on the opposite (top) surface of the large bell by the weight of the charge thereon and by force exerted thereon by the operating mechanism connected thereto.

Devices used previously to provide additional pressure on the top surface of the large bell to equalize the full furnace pressure exerted on the bottom surface thereof by top gas, to enable opening of the large bell for feeding charge therethrough into the blast furnace, generally included elements located remote from the blast furnace for scrubbing the top gas to remove pollutants therefrom and for directing the scrubbed top gas into the large bell hopper; scrubbing of the top gas to remove pollutants therefrom was necessary since top gas in the large bell hopper was vented to atmosphere when the small bell was opened to feed charge into the large bell hopper.

Blast furnaces are presently being operated at high internal furnace pressures in order to generate more intimate contact of denser mixtures of gas so as to generate greater production and increased efficiency. Such high internal furnace pressures, however, generate high top gas pressure which is exerted on the bottom surface of the large bell such that it interferes with opening of the large bell for feeding charge therethrough into the blast furnace. The remote location of elements in devices previously used to provide equalizing pressure generated substantial pressure drops through such devices, which loss of pressure prevented the use thereof for equalizing such high pressure top gas. Furthermore, such devices previously used included a shutoff valve in the duct leading into the large bell hopper, which valve was subject to improper and incomplete sealing resulting in loss of equalizing pressure, enabling back flow of top gas therefrom upon opening of the large bell for feeding charge therethrough into the blast furnace, and generating the formation of pockets of stagnant gas subject to condensing, freezing or exploding due to ambient conditions thereabout. Still further, such devices previously used included valves in the top gas uptakes leading from the blast furnace which relieved pressure by venting top gas therethrough in the event that a slip developed in the blast furnace generating a sudden pressure surge; such direct venting of top gas to atmosphere, however, also vented the carbon monoxide and dust therein which polluted the atmosphere.

SUMMARY OF THE INVENTION

In view of the above, it is an object of this invention to provide an apparatus for equalizing the pressure exerted by top gas, generated during operation of the blast furnace, on the bottom surface of the large bell movably mounted in the top of the blast furnace to enable opening of the large bell for feeding charge therethrough into the blast furnace. Another object of this invention is to provide such an apparatus which maintains full furnace pressure in the large bell hopper, which prevents back flow of top gas into the apparatus upon opening of the large bell for feeding charge therethrough into the blast furnace, and which prevents the formation of pockets of stagnant gas subject to condensing, freezing or exploding due to ambient conditions thereabout. Still another object of this invention is to provide such an apparatus which efficiently relieves sudden pressure surges and prevents damage to the blast furnace while preventing pollution of the atmosphere.

The above objects and others are provided for in this invention by means of an apparatus located at the top of a blast furnace for equalizing pressure exerted by top gas, generated during operation of the blast furnace, on the bottom surface of the large bell movably mounted in the top of the blast furnace, operable so as to remove pollutants from the top gas and direct the top gas with the pollutants removed therefrom into the large bell hopper at full furnace pressure, to exert equalizing pressure on the top surface of the large bell to enable opening of the large bell for feeding charge therethrough into the blast furnace. A stream of water under pressure is directed through a portion of the apparatus so as to generate continuous flow of cleaned top gas into the large bell hopper to maintain full furnace pressure therein, to prevent back flow of top gas into the apparatus upon opening of the large bell for feeding charge therethrough into the blast furnace, and to prevent the formation of pockets of stagnant gas subject to condensing, freezing or exploding due to ambient conditions thereabout. A relief valve is operable so as to vent cleaned top gas to atmosphere in the event that there is a slip in the blast furnace generating a sudden pressure surge, to efficiently relieve the pressure surge and prevent damage to the blast furnace while preventing pollution of the atmosphere.

DESCRIPTION OF THE DRAWINGS

This invention is illustrated, by way of example, in the accompanying drawings, wherein.

DESCRIPTION OF THE PREFERRED EMBODIMENT

Figure 1:
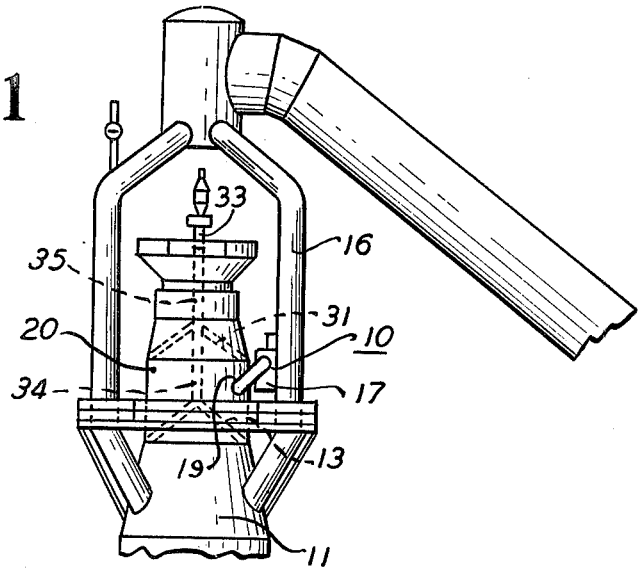
FIG. 1 is an elevational partly-fragmentary view of a blast furnace with the pressure equalizing apparatus connected thereto, pursuant to the invention.
Figure 2:
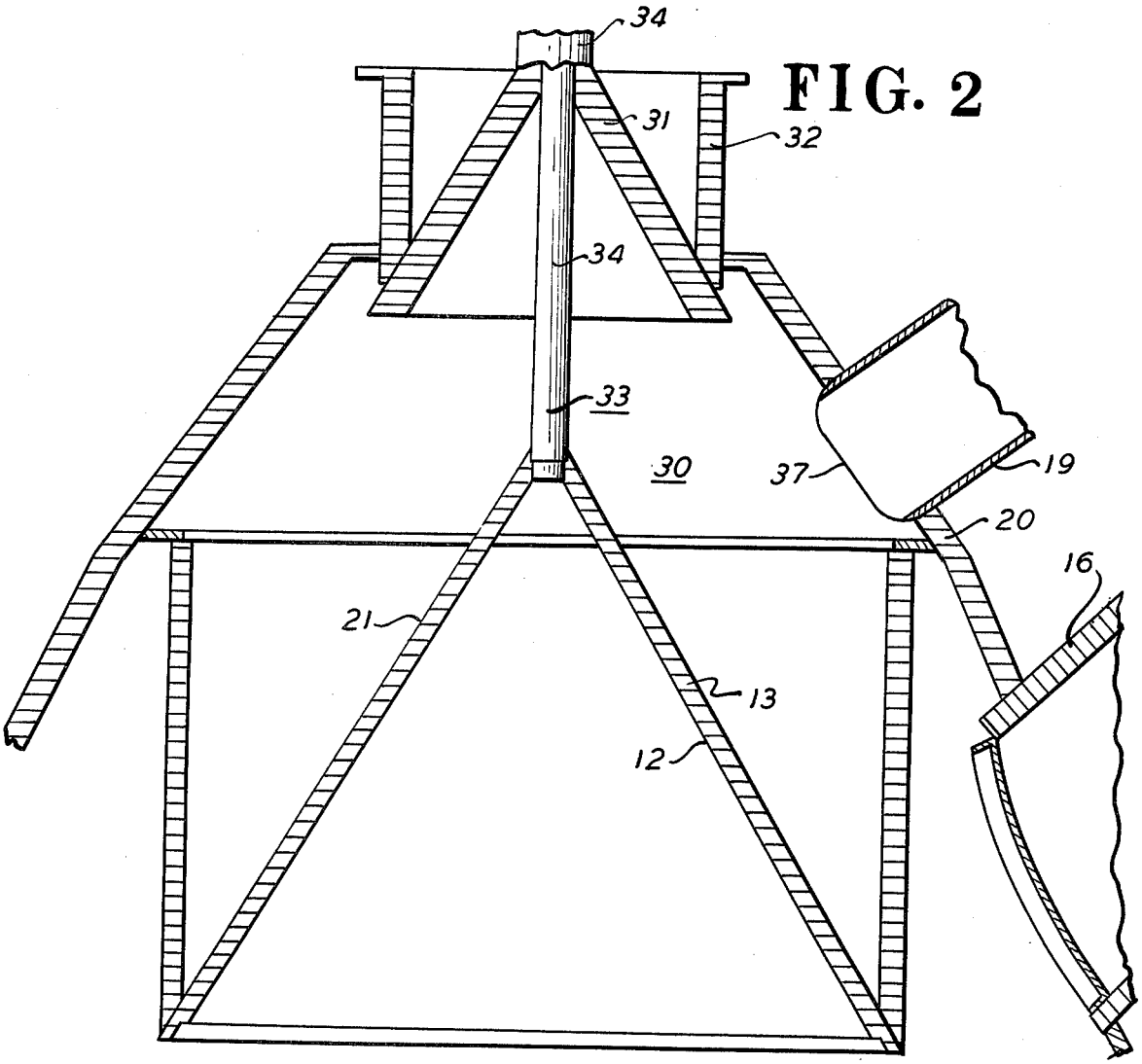
FIG. 2 is an elevational cross-sectional partly-fragmentary view of the large and small bells, the uptake and the connecting duct from the pressure equalizing apparatus.
Figure 3:
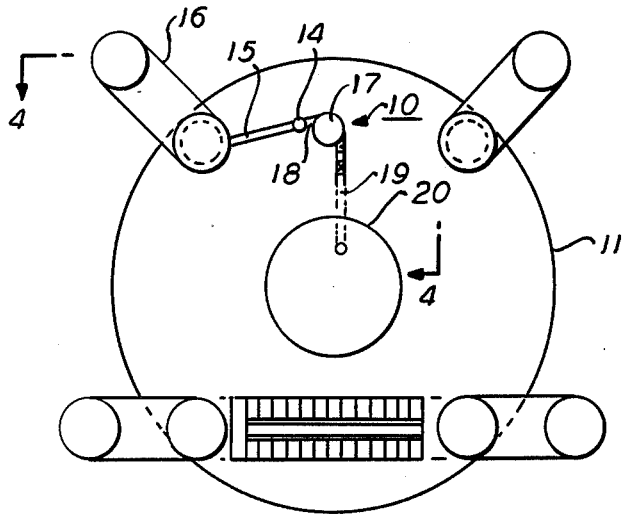
FIG. 3 is a top plan view of the blast furnace with the pressure equalizing apparatus connected thereto.
Figure 4:
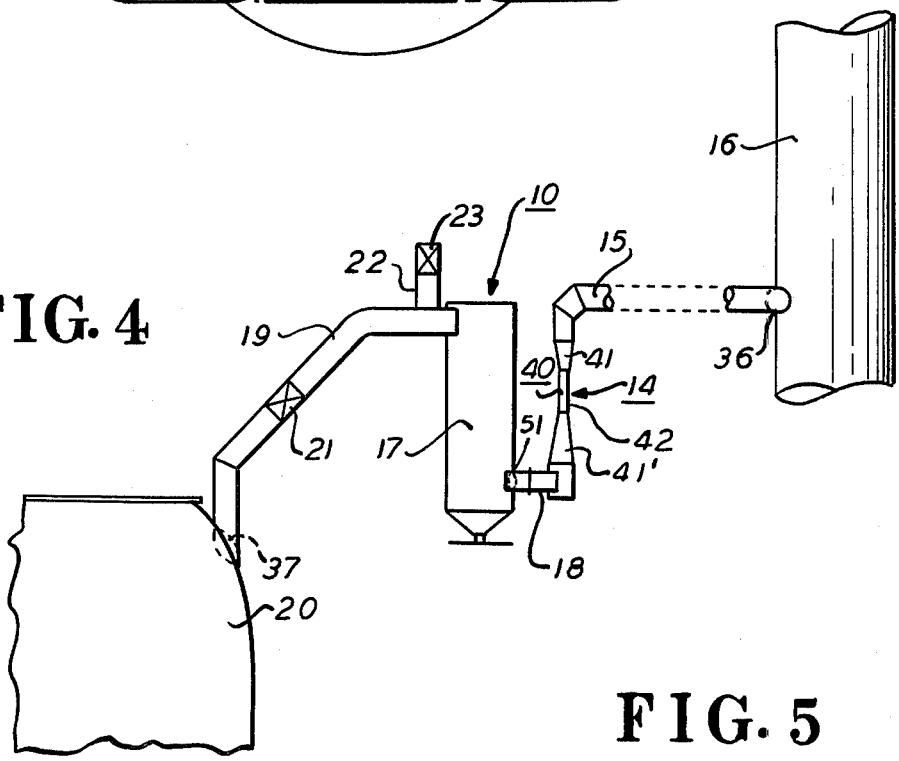
FIG. 4 is an elevational partly-fragmentary view of the large bell hopper and the uptake with the pressure equalizing apparatus connected thereto.
Figure 5:
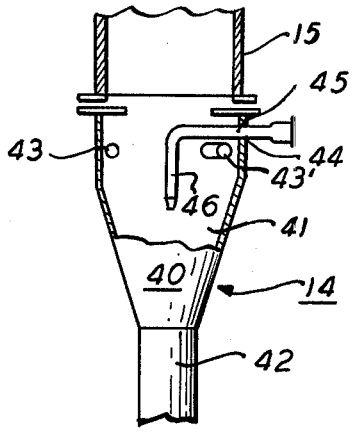
FIG. 5 is an elevational fragmentary partly-sectional view of the venturi scrubber and connecting duct of the pressure equalizing apparatus, pursuant to the invention.

In the preferred embodiment of the invention, as illustrated in FIGS. 1-5 for example, the apparatus 10 located at the top of the blast furnace 11 for equalizing pressure exerted by top gas, generated during operation of the blast furnace 11, on the bottom surface 12 of the large bell 13 movably mounted in the top of the blast furnace 11, comprises a venturi scrubber 14, a connecting duct 15 which connects the venturi scrubber 14 to one of the uptakes 16 which lead from the top portion of the blast furnace 11, a separator 17, a connecting duct 18 which connects the separator 17 to the venturi scrubber 14, a connecting duct 19 which connects the separator 17 to the hopper 20 of the large bell 12, a shut-off valve 21 mounted in the connecting duct 19, a relief valve 23, and a connecting duct 22 which connects the relief valve 23 to the connecting duct 19.

The large bell 13, which is generally conical in shape, and the large bell hopper 20 comprise portions of the top closing device 30 of the blast furnace 11, which top closing device 30 further includes a small bell 31, which is generally conical in shape, a small bell hopper 32, and an operating mechanism 33 which includes an inner shaft 34 connected to the large bell 13 and an outer hollow shaft 35 connected to the small bell 31 and keyed to the inner shaft 34. The wall of the uptake 16 has an opening 36 therein, and the wall of the large hopper 20 has an opening 37 therein.

The venturi scrubber 14 comprises a wall 40 including flared end portions 41, 41' thereof which are generally conical in shape and a constricted medial portion 42 thereof which is generally tubular in shape. The flared end portion 41 of the wall 40 has tangential openings 43, 43' and a further opening 44 therein. A tubular member 45 extends through the opening 44 and includes a downwardly-directed end portion 46.

During operation of the blast furnace 11 in producing pig iron from charge which includes metallurgical coke, iron ore, and fluxes, such charge is fed stepwise into the blast furnace 11 through the top closing device 30 as follows: first the charge is fed into the small bell hopper 32; then the operating mechaism 33 lowers the small bell 31, the charge is fed into the large bell hopper 20, and the operating mechanism 33 raises the small bell 31; and then the operating mechanism 33 lowers the large bell 13, the charge is fed into the blast furnace 11, and the operating mechanism 33 raises the large bell 13. Top gas, which includes carbon monoxide and dust therein, is generated in substantial quantities in the top of the blast furnace 11. Such top gas exerts full furnace pressure on the bottom surface 12 of the large bell 13, partially counterbalanced by pressure exerted on the top surface 24 of the large bell 13 by the weight of the charge thereon and by force exerted thereon by the operating mechanism 33 connected thereto. During operation of the blast furnace 11 at high internal furnace pressures, in order to generate more intimate contact of denser mixtures of gases therein so as to generate greater production and increased efficiency, high top gas pressure is generated which is exerted on the bottom surface 12 of the large bell 13 such that it interferes with opening of the large bell 13 for feeding charge therethrough into the blast furnace 11. Such high pressure top gas is directed from the blast furnace 11 through the uptakes leading therefrom, some of which flows through uptake 16 and through opening 36 therein, through connecting duct 18, and into flared end portion 41 of wall 40 of venturi scrubber 14. Water under pressure is directed through tangential openings 43, 43' in flared end portion 41 of wall 40 of venturi scrubber 14 into and about the inner surface thereof and into the path of the high pressure top gas, which, together with the flow of such high pressure top gas and water through the constricted medial portion 42 of the venturi scrubber 14, generates turbulent action which reduces the water into fine droplets and impresses thereon pollutants from the top gas. Such high pressure top gas, cleaned by the removal therefrom of pollutants as a result of the turbulent action generated in the venturi scrubber 14, and the fine water droplets with the top gas pollutants impressed thereon, are then directed through the flared end portion 41' of the wall 40 of venturi scrubber 14, through connecting duct 18 and into the separator 17, wherein such fine water droplets with top gas pollutants impressed thereon are separated from the cleaned top gas. The shut-off valve 21 is opened, and a surge of high pressure cleaned top gas is then directed from the separator 17, through the connecting duct 19, through the opening 37 in the wall of the hopper 20, and into the large bell hopper 20, whereupon such cleaned top gas builds up the pressure therein to full furnace pressure exerted on the top surface 24 of the large bell 13, to enable opening thereof for feeding charge therethrough into the blast furnace 11. As the pressure in the large bell hopper 20 builds up to full furnace pressure, the flow of cleaned top gas diminishes to the point where there is virtually no flow thereof when the pressure in the large bell hopper 20 is almost equal to the pressure in the blast furnace, whereupon a stream of cleaned top gas is generated so as to flow into the large bell hopper 20 by the flow of a stream of water under pressure through tubular member 45 and downwardly-directed end portion 46 thereof and through venturi scrubber 14, so as to generate continuous flow of cleaned top gas into the large bell hopper 20 at all times to maintain full furnace pressure therein. Such continuous flow of cleaned top gas further prevents back flow of top gas from the large bell hopper 20 into the apparatus 10 upon opening of the large bell 13 for charging the blast furnace 11, and prevents the formation of pockets of stagnant gas subject to condensing, freezing or exploding in the connecting ducts 18 and 19 due to ambient conditions thereabout. The shut-off valve 21 is closed only during lowering and raising of the small bell 31, in order to prevent excessive venting of cleaned top gas to atmosphere for efficient operation. In the event that there is a slip in the blast furnace 11 generating a sudden pressure surge, relief valve 22 vents cleaned top gas to atmosphere to efficiently relieve such pressure surge and prevent damage to the blast furnace 11 while preventing pollution of the atmosphere.

The top closing device 30 may comprise a damper, a swinging gate, or other device for feeding charge into the blast furnace, and the blast furnace may be used for production of a product other than pig iron.

While the invention has been set forth above in terms of a specific embodiment thereof, it is to be understood that variations may be made therein by those skilled in the art, which variations may nevertheless be within the scope and spirit of the invention. The invention, therefore, is to be broadly construed within the scope and spirit of the appended claims.

I claim:

1. An apparatus for equalizing the pressure exerted by top gas, generated during operation of a blast furnace, on one surface of a closing element movably mounted in the top of the blast furnace, comprising:

(a) means for cleaning the top gas in the apparatus and directing the cleaned top gas through the apparatus and into the chamber in which the closing element is movably mounted so as to exert equalizing pressure on the opposite surface of the closing element, comprising means for directing top gas from the blast furnace and for directing a liquid in a dispersed spray into the path of the top gas so that the liquid is reduced into fine droplets and so that pollutants from the top gas are impressed on such find liquid droplets, including a wall portion including flared end portions and a constricted medial portion, and in which one of the flared end portions has openings therein for injection of a liquid therethrough, means for directing the cleaned top gas and the fine liquid droplets with top gas pollutants impressed thereon from the top gas directing means and for separating the fine liquid droplets with top gas pollutants impressed thereon from the cleaned top gas, and means for directing cleaned top gas from the cleaned top gas and fine liquid droplets directing means into the chamber in which the closing element is movably mounted so as to exert equalizing pressure on the opposite surface of the closing element; and (b) means for generating substantially continuous flow of the cleaned top gas into the chamber in which the closing element is movably mounted, including means for directing liquid in a concentrated stream through a portion of the top gas directing means of the top gas cleaning means, which extends through one of the openings in the flared end portion of the top gas directing means of the top gas cleaning means, including an outlet portion which extends parallel to the axis of the wall of the top gas directing means of the top gas cleaning means.

2. An apparatus as in claim 1, in which the outlet portion of the liquid directing means comprises a tubular outlet portion.

* * * * *